United States Patent [19]

Harmuth

[11] Patent Number: 4,506,267

[45] Date of Patent: Mar. 19, 1985

[54] FREQUENCY INDEPENDENT SHIELDED LOOP ANTENNA

[75] Inventor: Henning F. Harmuth, Potomac, Md.

[73] Assignee: Geophysical Survey Systems, Inc., Hudson, N.H. ; a part interest

[21] Appl. No.: 461,153

[22] Filed: Jan. 26, 1983

[51] Int. Cl.[3] ..... H01Q 11/04

[52] U.S. Cl. ..... 343/744; 343/842; 343/846

[58] Field of Search ..... 343/708, 741, 748, 743, 343/744, 794, 807, 841, 842, 845, 846

[56] References Cited

U.S. PATENT DOCUMENTS

| | | | |
|---|---|---|---|
| 2,365,207 | 12/1944 | Moles | 343/703 |
| 2,419,577 | 4/1947 | Libby | 343/842 |
| 3,147,439 | 9/1964 | Eakin | 343/703 |
| 3,478,366 | 11/1969 | Ricardi et al. | 343/769 |

*Primary Examiner*—Eli Lieberman

*Attorney, Agent, or Firm*—Louis Orenbuch

[57] ABSTRACT

An antenna is disclosed that is especially useful for radiating and receiving non-sinusoidal electromagnetic waves. The antenna is an efficient and distortion-free radiator of electromagnetic pulses that do not use a sinusoidal carrier. The antenna's size is independent of frequency and the antenna, therefore, can be of small size relative to the wavelength of the radiated electromagnetic waves. When used for reception of electromagnetic wave energy, the antenna performs with low distortion. The basic concept underlying the invention is the modification of the Hertzian electric dipole into an antenna structure that can carry large currents without requiring a large driving voltage. Antennas for the transmission or reception of sinusoidal waves achieve that goal by employing resonant structures. The invention achieves the same result by changing the Hertzian electric dipole into a loop that forms a Hertzian magnetic dipole and preventing the undesirable magnetic dipole radiation by shields of conducting and absorbing materials.

3 Claims, 10 Drawing Figures

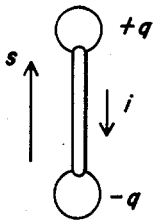
FIG. 1A
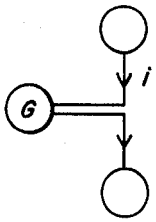
FIG. 1B
FIG. 2A
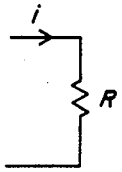
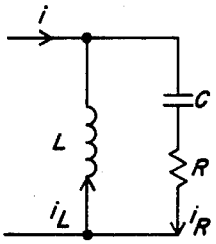
FIG. 2B
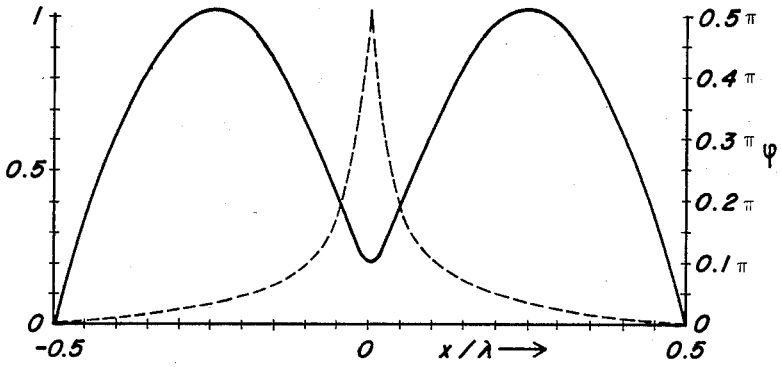
FIG. 3
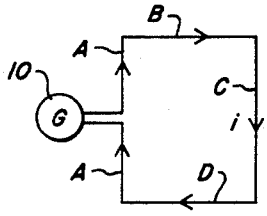
FIG. 4A
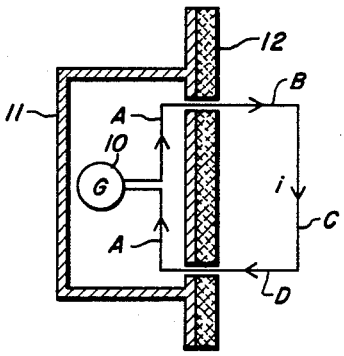
FIG. 4B
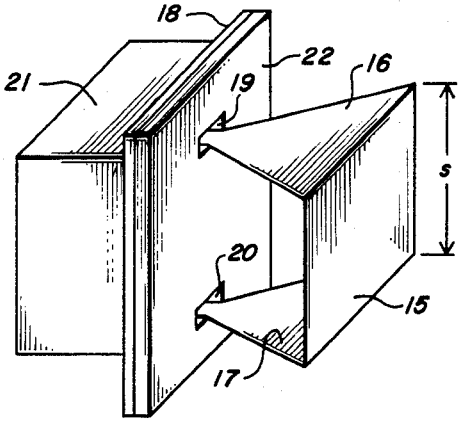
FIG. 4C

FREQUENCY INDEPENDENT SHIELDED LOOP ANTENNA

FIELD OF THE INVENTION

This invention relates in general to antennas for the radiation of electromagnetic wave energy. More particularly, the invention pertains to an antenna that efficiently and with low distortion radiates electromagnetic wave energy that does not have the usual sinusoidal or nearly sinusoidal time variation associated with amplitude modulation, frequency modulation, phase modulation, frequency shift keying, continuous wave transmission, controlled carrier modulation, etc. The invention is especially useful for the radiation of electromagnetic pulse energy where the pulse waveform applied to the antenna's input differs appreciably from a sinusoid.

BACKGROUND OF THE INVENTION

Within recent times, a variety of uses have arisen requiring the radiation of electromagnetic wave energy that is not itself of sinusoidal waveform and which does not employ a sinusoidal carrier. In the context of this discussion the term "sinusoidal" includes waveforms that are approximately sinusoidal such as those encountered in frequency modulation or amplitude modulation of a sinusoidal carrier. Those recently arisen uses are primarily in radar and to a lesser extent in specialized forms of radio communications usually referred to as "spread spectrum" or "frequency sharing" systems. The uses in radar include all-weather line-of-sight radars, over-the-horizon radars, and geophysical survey systems of the kind disclosed in U.S. Pat. No. 3,806,795. Some of those radar uses and other uses are discussed in the book titled "Nonsinusoidal Waves For Radar And Radio Communications" by Henning F. Harmuth, Academic Press, New York, 1981.

It is generally agreed that the most troublesome area in radio systems using nonsinusoidal waves is in providing suitable antennas for those systems, particularly the antenna used for radiation. Many types of so-called frequency independent antennas are known such as the log-spiral antenna, the horn antenna, the exponential surface antenna, etc. Such "prior art" antennas are discussed in the book "Frequency Independent Antennas" by Victor H. Rumsey, Academic Press, New York, 1966. Those antennas usually permit radiation of sinusoidal waves within a wide frequency range whereas the resonant type of antenna only permits radiation of sinusoidal waves within a relatively narrow band. However, the "prior art" frequency independent antennas usually cause significant distortions where a nonsinusoidal wave or wave energy with large relative bandwidth is radiated. Moreover, most of those "prior art" frequency independent antennas are of large physical size.

The term "relative bandwidth" is fundamental to a discussion of the transmission of nonsinusoidal waves. Relative bandwidth in conventional radio transmission means the quotient $\Delta f/f_c$ where $\Delta f$ is the frequency bandwidth and $f_c$ is the carrier frequency of a radio signal. Nonsinusoidal electromagnetic waves, however, do not have a carrier frequency $f_c$. Therefore, the more general definition $$\eta = \frac{f_H - f_L}{f_H + f_L}$$

is used for the relative bandwidth, where $f_H$ and $f_L$ stand respectively for the highest and lowest frequency of interest. For a pure sinusoidal wave $f_H = f_L$ and consequently the relative bandwidth is zero. The conventional sinusoidal signals used in radio, TV, radar, radio navigation, etc., typically have a relative bandwidth of 0.01 or less. The largest possible value of $\eta$ is 1 and applies, for example, to a rectangular pulse occupying the frequency band from zero to infinity.

Most "prior art" frequency independent antennas are useful for small relative bandwidths only, that is, for relative bandwidths of about 0.01 or less. The antenna of this invention, in contrast, can radiate and receive electromagnetic signals with a relative bandwidth $\eta$ of close to 1. Moreover, the antenna of this invention, when used for transmission, can be constructed of small size by trading off an increase in current for smaller size.

THE DRAWINGS

FIG. 1A shows a Hertzian electric dipole.

FIG. 1B shows the Hertzian electric dipole driven by a current source.

FIGS. 2A and 2B diagrammatically illustrate the use of resonance to increase the power delivered to a resistance R from a current source.

FIG. 3 is a graph of the relative amplitude and phase of the current in a resonating dipole for sinusoidal waves.

FIG. 4A shows a Hertzian magnetic dipole.

FIG. 4B shows the large current, short length dipole of the invention derived from the Hertzian magnetic dipole.

FIG. 4C is a perspective view of a preferred embodiment of the invention.

Figure 5A:
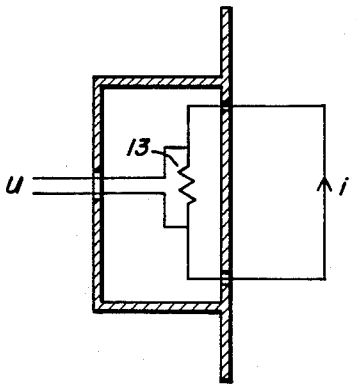

FIG. 5A shows the large current, short length dipole of the invention used as a receiving antenna operating into a resistance.

Figure 5B:
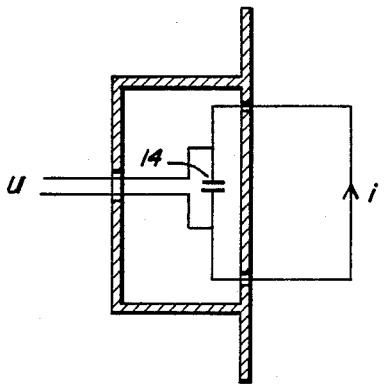

FIG. 5B shows the large current, short length dipole of the invention operating into a capacitance.

DETAILED DESCRIPTION

The basis for antenna theory is the Hertzian electric dipole which can be represented, as in FIG. 1A, by two charges +q and −q located at opposite ends of a dipole represented by the vector s. Time variation of the charges causes a current i to flow from one end of the dipole to the other. In a practical implementation of that arrangement, shown in FIG. 1B, a generator G forces a current i to flow in the dipole which causes charges +q and −q to appear at opposite ends of the dipole.

Heinrich Hertz solved Maxwell's equations for the electric dipole with a current having a sinusoidal time variation. See "Electric Waves" by Heinrich Hertz, pp. 137–159, MacMillan, London, 1893. The solution for general time variation $i=i(t)$ was subsequently elaborated by others in published works such as, Theorie der Elecktrizität by M. Abraham, Vol. 2, §13, Teubner, Leipzig 1905; The Classical Theory of Electricity and Magnetism by M. Abraham and R. Becker, Part III, Chapter X, section 11, Hafner, New York, 1932; and Theorie der Elecktrizität by R. Becker and F. Sauter, Vol. 1, 18ed., D III §67, Teubner, Stuttgart, 1964. With $E=E(r, t-r/c)$ and $H=H(r, t-r/c)$, one obtains for the electric and magnetic field strengths produced by the dipole at a point at the distance r:

$$E = Z_o \frac{s}{4\pi c}\left[\frac{1}{r}\frac{di}{dt}\frac{r\times(r\times s)}{sr^2} + \left(\frac{c}{r^2}i + \frac{c^2}{r^3}\int i\,dt\right)\left(\frac{r\times(r\times s)}{sr^2} + 2\frac{(s\cdot r)r}{sr^2}\right)\right] \quad (1)$$

$$H = \frac{s}{4\pi c}\left(\frac{1}{r}\frac{di}{dt} + \frac{c}{r^2}i\right)\frac{s\times r}{sr} \quad (2)$$

Here, $Z_o$=377 ohms, the wave impedance of free space, c is the velocity of light, s is the previously defined dipole vector of length s, and r is the location vector from the dipole to the point where E and H are produced.

The terms in equations (1) and (2) of primary interest are the ones which decrease with 1/r because those terms dominate in the far field. The time variation of those terms equals that of the first derivative di/dt of the dipole current; a fact that is usually not recognized for sinusoidal currents $i=I_o \sin \omega t$ because the derivative $di/dt=I_o\omega \cos \omega t$ differs only by the factor $\omega$ and a phase shift of the current i.

In order to produce large electric and magnetic field strengths and thus a large power density div $P=div\,(E\times H)$ for a certain time variation f(t) of the current $i(t)=I_o$ f(t) a large amplitude $I_o$ of the dipole current must be produced. It is evident from FIG. 1B that a large current implies large charges at the ends of the dipole, which, in turn, require a large driving voltage due to the small capacity of the dipole. This need to produce a current and a charge shows up in the terms in equation (1) that vary like i and $\int$idt. Those terms do not contribute significantly to the power radiated to the far field and though they are negligible for radiation to the far field, they create ohmic losses due to the current i flowing through the generator G and the antenna. Moreover the high voltage required by the term $\int$idt is a severe drawback.

For sinusoidal currents the drawbacks of the Hertzian electric dipole are overcome by the resonant dipole. To see the underlying physical principle consider the FIG. 2A circuit with the resistor R. A sinusoidal current $i=I_o \sin \omega t$ will cause the average power $\frac{1}{2}I_o^2$ R to be dissipated by the resistor. To increase that power, the amplitude $I_o$ of the current must be increased. A transformer can be used to do so. Another way is to employ a resonant circuit, as shown in FIG. 2B. In the resonance case $\omega^2LC=1$ the following currents i, $i_L$, and $i_R$ are obtained:

$$i = I_o \sin\omega t \quad (3)$$

$$i_L = I_o\frac{Z}{R}\left(\cos\omega t - \frac{R}{Z}\sin\omega t\right) \quad (4)$$

$$i_R = I_o\frac{Z}{R}\cos\omega t \quad (5)$$

$$Z = \sqrt{L/C}\ ,\ \omega^2LC = 1 \quad (6)$$

The current $i_R$ flowing through resistor R now contains the factor Z/R, and for Z>R a larger current will flow through resistor R of FIG. 2B than in the FIG. 2A resistor. Equation (4) may be rewritten by introducing the amplitude $I=I_o(Z/R)$ of the resonant current:

$$i_L = I\left(\cos\omega t - \frac{R}{Z}\sin\omega t\right) \quad (7)$$

For R→0 the term (R/Z) sin $\omega$t vanishes and only I cos $\omega$t remains, which justifies the name "resonant current" for I cos $\omega$t.

This principle for the increase of current by means of resonance is used in resonating antennas. For instance, the current distribution along an infinitely thin full wave dipole with center feed is given by the equation:

$$i(x,t) = I\left[\sin\frac{2\pi|x|}{\lambda}\cos\omega t - \frac{R_a}{Z_o}\,\frac{1+\cos 2\pi x/\lambda}{2}\sin\omega t\right] \quad (8)$$

Where $R_a$ stands for the radiation resistance, $Z_o$ is the wave impedance of free space x, with the range $-\lambda/2 \leqq x \leqq +\lambda/2$, is the space variable along the antenna. Equation (8) has the same form as equation (7), except that terms for the distribution of current along the antenna are added. For $R_a$=0, the second term in equation (8) vanishes; this term thus gives the *radiating current* fed into the antenna to produce radiated power. The first term in equation (8) is the resonating current. For $R_a<Z_o$ the radiating current is smaller than the resonating current, but the radiating current increases proportional to the resonating current because they have the common factor I in equation (8). The principle of the resonating dipole is thus that the resonating current and with it the radiating current increases until all the power delivered by the power source to the antenna is radiated. The large resonating current does not flow through the power source, and no large voltages are needed to force charges onto the antenna. Consequently, the primary drawbacks of the Hertzian electric dipole are avoided.

To more clearly show the difference between radiating and resonating currents, equation (8) is rewritten in the following form:

$$i(x,t) = I\left[\sin^2\frac{2\pi x}{\lambda} + \left(\frac{R_a}{Z_o}\,\frac{1+\cos 2\pi x/\lambda}{2}\right)^2\right]^{\frac{1}{2}}\cos(\omega t + \rho) \quad (9)$$

$$\rho = \tan^{-1}\frac{R_a}{Z_o}\,\frac{1+\cos 2\pi x/\lambda}{2\sin 2\pi|x|/\lambda} \quad (10)$$

The relative amplitude of this current—given by the bracketed term in equation (9)—and the phase $\phi$ are plotted in FIG. 3. For x/λ=0 we get the current fed into the dipole from the power source. Much larger currents flow for other values of x/λ, and they help to increase the radiated power to the level of power which the power source can deliver.

We learn from the resonating antenna two points for the design of antennas for nonsinusoidal waves, as follows: (a) the antenna must readily permit large currents, and (b) there must be a mechanism that permits as much power to be radiated as the power source can deliver to the antenna. The Hertzian electric dipole fails to meet both requirements, but it permits the radiation of waves with any time variation while the resonating antenna only radiates sinusoidal waves with certain wavelengths.

The problems of the Hertzian dipole can be overcome in principle by using the loop depicted in FIG. 4A. The conductive leg C of that loop radiates essentially like the FIG. 1B dipole but no charges can accumulate at its ends and a large current can thus be produced with a small driving voltage. If only the conductive leg C but not conductors A, B, and D in FIG. 4A radiate, one obtains the following field strengths produced by the current i, $$E(r,t-r/c) = -Z_o \frac{s}{4\pi cr} \frac{di}{dt} \frac{s}{s} \tag{11}$$

$$H(r,t-r/c) = \frac{s}{4\pi cr}\left(\frac{1}{r}\frac{di}{dt} + \frac{c}{r^2} i\right) \frac{s \times r}{sr} \tag{12}$$

where s is a vector of the length and direction of conductor C pointing in the opposite direction as direction of current flow indicated in FIG. 4A. The magnetic field strengths of equations (2) and (12) are the same, but only the far field component of equation (1) is contained—in slightly modified form—in equation (11); the objectionable terms containing i and $\int idt$ have been eliminated. Unfortunately, if an antenna according to FIG. 4A is used without any modification, the radiation of a Hertzian magnetic dipole is obtained, $$E = Z_o \frac{a}{4\pi c^2}\left(\frac{1}{r}\frac{d^2i}{dt^2} + \frac{c}{r^2}\frac{di}{dt}\right) \frac{a \times r}{ar} \tag{13}$$

$$H = -\frac{a}{4\pi c^2}\left[\frac{1}{r}\frac{d^2i}{dt^2}\frac{r \times (r \times a)}{ar^2} + \left(\frac{c}{r^2}\frac{di}{dt} + \frac{c}{r^3} i\right)\left(\frac{r \times (a \times r)}{ar^2} + 2\frac{(a \cdot r)r}{ar^2}\right)\right] \tag{14}$$

where a is a vector representing the area around which the current flows in FIG. 4A.

From equations (13) and (14) we see that the far field components of E and H now vary like the second derivative $d^2i/dt^2$ of the antenna current. Any slight deviation of the current i from its nominal time variation will be magnified in the first derivative di/dt, and even more so in the second derivative $d^2i/dt^2$. Hence, it is inherently difficult to obtain "clean" waves with a magnetic dipole for currents with arbitrary time variation.

To obtain electric dipole radiation from the FIG. 4A loop, the generator 10 and conductors A, A are shielded, as shown in FIG. 4B, by enclosing them in a metallic housing 11. By making conductors B and D short compared with the length of conductor leg C we obtain electric and magnetic field strengths according to equations (11) and (12).

To overcome problems arising from surface currents induced in the metal shield 11, those surface currents can be suppressed by a cover 12 of absorbing material. A suitable material for the cover 12 is a layer of a sintered ferrite material known as ECCOSORB-NZ made by the Emerson and Cumming Company of Canton, Mass. The cover 12 is not needed where the metal shield is large and made of a lossy material such as galvanized steel. Because radiation produced by the surface currents comes primarily from the edges of the shield, that radiation can be made negligible by extending the shield to provide greater absorption of the induced surface currents.

The radiating conductive leg C in FIG. 4B preferably is in the form of metal sheet rather than a single wire. For example, FIG. 4C shows such an embodiment of the invention. In that preferred embodiment, the conductive leg of length s is a rectangular metal sheet 15. At its upper and lower ends the metal sheet is bent and forms triangular sheet metal arms 16 and 17 which correspond to conductors B and D in FIG. 4B. The triangular arms 16 and 17 taper toward the shield plate 18 which has apertures 19, 20 permitting the arms to extend through that plate into the shield housing 21. As previously explained in connection with FIG. 4B, the current generator 10 and that portion of the loop opposite to conductive leg 15 (i.e. the conductors A,A opposite conductor C in FIG. 4B) are situated in the shield housing 21. In the FIG. 4C embodiment, the shield plate is covered by an absorbent layer 22. However, as previously explained, in lieu of the absorbent layer the shield plate can be constructed of a lossy material to suppress induced surface currents and the shield plate can be extended to provide greater attenuation of those currents as they flow toward the edges of the plate.

The major advantage of the novel antenna can be appreciated from equations (11) and (12). The far field components of E and H vary like $s\ di/dt = sI_o df/dt$. Hence, a large current amplitude $I_o$ can be exchanged for a shorter antenna length s. This is something that cannot be done with a resonating dipole. Furthermore, a large current flowing through generator 10 in FIG. 4B would be objectionable for sinusoidal currents, but not for a generator producing a two-valued on-off current. The utility of a small but powerful transmitting antenna like that shown in FIG. 4C is obvious for applications where the antenna must be easily transportable and yet capable of radiating substantial power.

Many antennas are known that permit the radiation of nonsinusoidal waves. Such antennas are usually termed "frequency independent" antennas. Examples are the biconical antenna, the horn antenna, the log-periodic dipole antenna, the log-spiral antenna, and the exponential surface antenna. None of them permits a trade-off of size for amplitude of the current.

Where the FIG. 4B type of antenna is to be used for reception rather than for radiation, the arrangement is modified as indicated in FIGS. 5A and 5B. By employing a resistor 13, as shown in FIG. 5A, whose resistance is large compared to $Z_o = 377$ ohms (the impedance of free space), an output voltage u is obtained having essentially the time variation of the current i, which in turn has the time variation of electric field strength E produced by a radiator at the location of the receiving antenna. If the resistor 13 is replaced by a capacitor 14, as shown in FIG. 5B, the output voltage has the time variation of the integral of the current i or the field strength E. In the practical implementation of receiving antennas like those of FIGS. 5A and 5B, the resistor 13 is replaced by a differential amplifier having a resistive input impedance and the capacitor 14 is replaced by a differential amplifier having a capacitor across its input terminals.

I claim:

1. An antenna for producing electric dipole radiation, comprising (a) electrically conductive means forming a loop, one portion of the loop being a radiator leg for radiating electromagnetic wave energy, (b) a current source for driving a current around the conducting loop, (c) shield means for confining radiation from the current source and that portion of the loop opposite the radiator leg, the shield means being disposed around the current source and that portion of the loop opposite the radiator, and (d) adsorbing material on the shield means, the absorbing material absorbing energy from surface currents induced in the shield means by radiation from the radiator leg.

2. An antenna for producing electrical dipole radiation, comprising (a) electrically conductive means forming a loop, one portion of the loop being a radiator leg for radiating electromagnetic wave energy, (b) a current source for driving a current around the conducting loop, and (c) shield means for confining radiation from the current source and that portion of the loop opposite the radiator leg, the shield means being disposed around the current source and that portion of the loop opposite the radiator leg, and the shield means being made of lossy material that attenuates surface currents induced in the shield means by radiation from the radiator leg.

3. A receiving antenna comprising (a) electrically conductive means forming a loop, one leg of the loop being an elongate conductor for sensing electromagnetic wave energy and providing a current derived therefrom, the leg opposite the sensing leg having in it a lumped impedance, (b) shield means shielding that opposite leg from electromagnetic wave energy to which the sensing leg is exposed, the shield means absorbing energy from surface currents induced in the shield means by the derived current flowing in the sensing leg, and (c) means for detecting a signal developed across the lumped impedance by the current flow in the loop.

* * * * *